United States Patent [19]

Schmidt

[11] 4,016,228

[45] Apr. 5, 1977

[54] METHOD FOR PROGRESSIVELY CONSTRUCTING A WALL OF CEMENTITIOUS MATERIAL

[75] Inventor: Hans Heinrich Schmidt, Doncaster, Australia

[73] Assignee: Enor Nominees Pty. Limited, Victoria, Australia

[22] Filed: Feb. 28, 1975

[21] Appl. No.: 554,235

Related U.S. Application Data

[62] Division of Ser. No. 448,716, March 6, 1974, abandoned.

[30] Foreign Application Priority Data

Mar. 7, 1973 Australia ..... 2511/73
Mar. 7, 1973 Australia ..... 2513/73

[52] U.S. Cl. ..... 264/33; 249/20; 249/22; 264/34; 425/65

[51] Int. Cl.[2] ..... E04B 1/16

[58] Field of Search ..... 264/33, 34; 249/20, 249/22; 425/63, 64, 65

[56] References Cited

UNITED STATES PATENTS

| | | | |
|---|---|---|---|
| 2,705,359 | 4/1955 | Strandberg | 264/33 X |
| 3,224,065 | 12/1965 | Cheskin | 425/65 |
| 3,453,707 | 7/1969 | Johansson | 264/34 X |

*Primary Examiner*—Robert F. White
*Assistant Examiner*—Thomas P. Pavelko
*Attorney, Agent, or Firm*—Murray and Whisenhunt

[57] ABSTRACT

A method of progressively constructing a wall of cementitious material, including the steps of supporting a formwork support structure on a lower foundation, or completed wall section, by means of hydraulic jacks each including a hydraulic ram assembly carrying the formwork support structure and adapted to climb up a vertically extending jack tube, raising said formwork support structure by said jacks to a higher pouring position, supporting said formwork support structure on the lower foundation, or wall section, by auxiliary support means, raising the jack tubes for each jack through its associated ram assembly, moving a formwork section on the outside of the wall toward a formwork section on the inside of said wall to provide a cavity for the receipt of cementitious material, pouring a quantity of said material into said space between said formwork sections, the lower foundation, or completed wall section, and the lower ends of the jack tubes, allowing said cementitious material to solidify, and moving the outer formwork section away from the wall and disengaging the inner formwork section, with said formwork support structure being supported on said jacks.

11 Claims, 15 Drawing Figures

Figure 1:
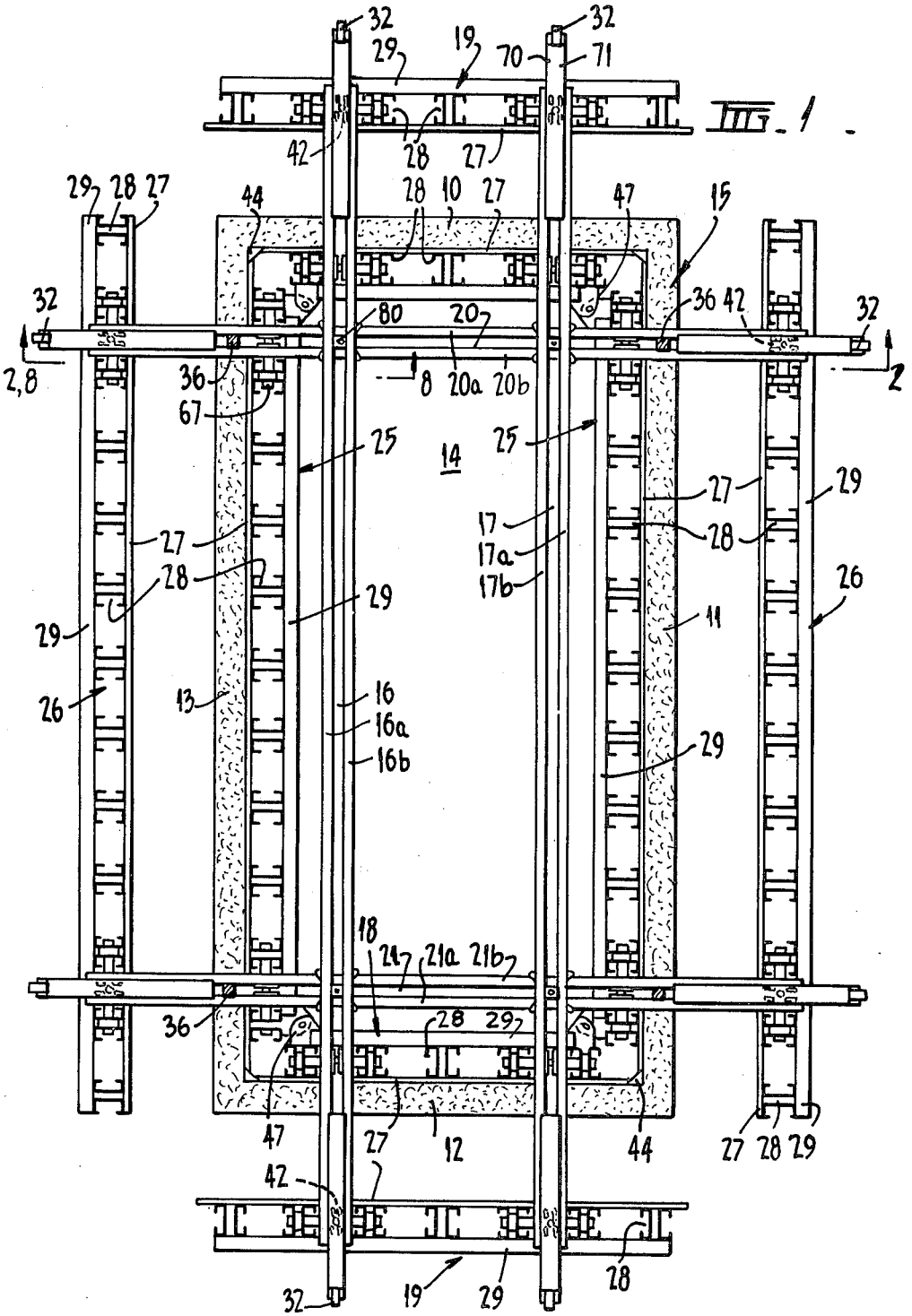

39
39
36
32
32
33
33
37
37
58
58
15
16
20
30
17
42
42
45
45
36
25
25
29
29
28
27
27
26
28
28
38
13
41
41
26
27
28
29
11
34
34
61
31
61
62
63a
63a
14

39
36
32
37
15
16
20
70
42
58
22
27
45
28
29
26
13
5
25
41
40
14
18

36
37
15
16
20
42
58
22
38
27
28
45
29
25
83
26
18
34
40
31
14

METHOD FOR PROGRESSIVELY CONSTRUCTING A WALL OF CEMENTITIOUS MATERIAL

This is a division of application Ser. No. 448,716 filed Mar. 6, 1974.

This invention relates to an improved method and apparatus for progressively constructing a wall of cementitious material.

The improved method and apparatus serves to facilitate the better handling of formworks used particularly for constructing vertical concrete walls for buildings and other structures.

It has been found in normal practice that considerable time is spent in assembling, and then dismantling and reassembling, the same individual formwork components in the same relative position only at a higher level during building construction or wall construction. In addition to the manpower used in this repetitive work, a crane or some other mechanical device must be used to support and elevate the individual formwork components.

In another well known process for adding steel reinforcing and fresh concrete to vertically sliding preassembled wall forms there is provided a method whereby the formwork is not dismantled and reassembled continuously, and instead the entire formwork is raised by its own hydraulic jacking system. One major problem with this known building process is that the forms used to contain the fresh concrete are subjected to pressure from the fluidized concrete. This pressure or force must be resisted by a rigid inverted U, or A, frames or yokes. These relatively rigid yokes must be closely spaced along the walls and near all corners of the walls in order to resist the tendency for the concrete pressures at various points to change the thickness of the wall or the shape of the structure. The cost of these numberous yokes is considerable and they congest the working area above the wall, particularly at the corners of the wall.

A further disadvantage lies in the fact that the concrete is produced by a moving form thus producing problems such as the wall surface directly opposite the formwork requires finishing, concrete slurry builds up on the face of the moving form and increases the problem of producing rough surfaces, the wall corners are often torn, door and window openings have rough edges due to loss of slurry in the concrete, textured surface finishes are not possible, placement of blockouts in the moving form are difficult whilst the holding down of the blockouts in the moving form is difficult.

Furthermore partial redesign of building is necessary to suit such a so-called slipform process. It is also difficult to stop said form in an emergency, and the fact that the forms often bond to the wall at the completion of the pour the forms must be cleaned on exposed faces after completion of the pour.

A further disadvantage is in the fact that the quantities and nature of the materials in the concrete must be capable of solidifying within the moving form, thus the concrete setting rate which is also subject to changes in the weather temperature must be carefully controlled. Failure to predict the concrete setting rate can result in a loss of partially solidified cpmcrete from the wall below the sliding form, or the hardened concrete adhering to the moving form.

Furthermore it is difficult to obtain access for personnel and materials to the moving form and also it is difficult and expensive to alter wall thickness, and finally a considerable amount of technical expertice is necessary to conrol the direction of the form.

It is therefore an object of the invention to provide an improved construction method and apparatus designed to reduce some of the aforementioned problems.

A still further problem with this method of concrete wall construction is the numerous jack rods which support the formwork via hydraulic jacks mounted in the closely spaced yokes. These rods are generally expended as they are cast in the wall or individually removed after, or during, construction of the wall. These small diameter steel rods are also subject to considerable vertical load and thus they have a limited capacity to resist buckling. The steel rods therefore must be supported laterally either by setting concrete or temporary timber supports, both of which are subject to failure.

In another known building construction method a separate overhead support system is used in association with the formwork. This method consists of an overhead support frame used to raise the formwork in part, or whole, with the overhead support frame itself when being raised. The overhead support frame is supported on columns fixed to the wall below the formwork. However, this system involves a considerable quantity of falsework whilst two lifting systems are also required.

It is an object of the present invention to provide an improved method and apparatus for constructing concrete walls which is not subject to any of the above disadvantages associated with known construction methods and apparatus involving the provision of formworks for concrete.

It is also an object of one preferred form of the invention to provide a stable and structurally sound internal form assembly within one or more cells of the building which can be raised in company with the remaining formwork and various working decks, one of which is used to define the location of the concrete walls at the top edge of the form.

According to a still further object one preferred form of the invention provides necessary access for two faces of the formwork in the raised position in order to allow cleaning of the form faces, the addition of steel reinforcement, the addition of suitable frames to form openings in the concrete wall, the addition of various textured surfaces that may be required on the finished wall, and also to make provision for protruding steel reinforcement used to form part of the floor slab or beam construction.

It is a still further object of the present invention to provide a method and apparatus that is easily understood and controlled by the personnel with normal trade experience.

The invention therefore envisages a method of progressively constructing a wall of cementitious material, including the steps of supporting a formwork support structure on a lower foundation, or completed wall section, by means of at least one jack means, raising said formwork support sturcture by said jack means to a higher pouring position, supporting said formwork support structure on the lower foundation, or wall section, by auxiliary support means, raising said jack means, moving a formwork section on at least one side of said wall toward a formwork section on the opposite side of said wall to provide a cavity for the receipt of cementitious material, pouring a quantity of said material into said space between said formwork sections, the lower foundation, or completed wall section, and the jack means, allowing said cementitious material to solidify, and separating said formwork sections, with said formwork support structure being supported on said jack means.

The invention also envisages an apparatus for progressively constructing a wall of cementitious material including a formwork support structure, at least one part of inner and outer formwork sections suspended from said support structure, at least one of which is adapted to move toward and away from the other, at least one jack means adapted to support said formwork support structure on a lower foundation or completed wall section and operable to lift said formwork support structure, said jack means being adapted to be movable to an upper lift position, retractable support means carried by said support structure and adapted to supportsaid formwork support structure on the lower foundation or completed wall section when said jack means are moved to said upper lift position.

Preferably said jack means is at least one hydraulic jack of the type where the load to be lifted, in this case the formwork support structure, is carried by a hydraulic ram assembly adapted to climb up a vertically extending jack tube the lower end of which engages in the top edge of the lower foundation or completed wall section.

Figure 2:
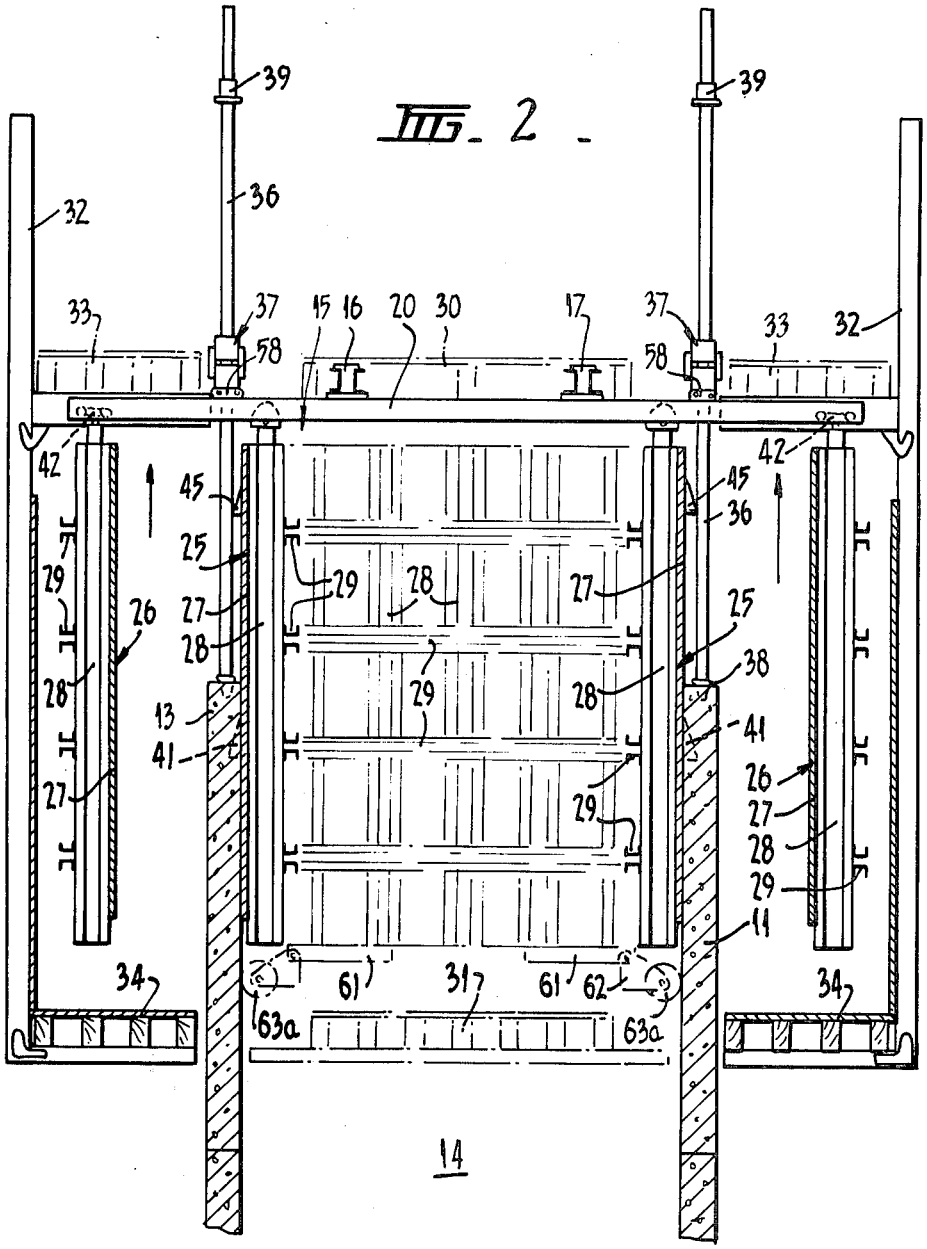
Figure 3:
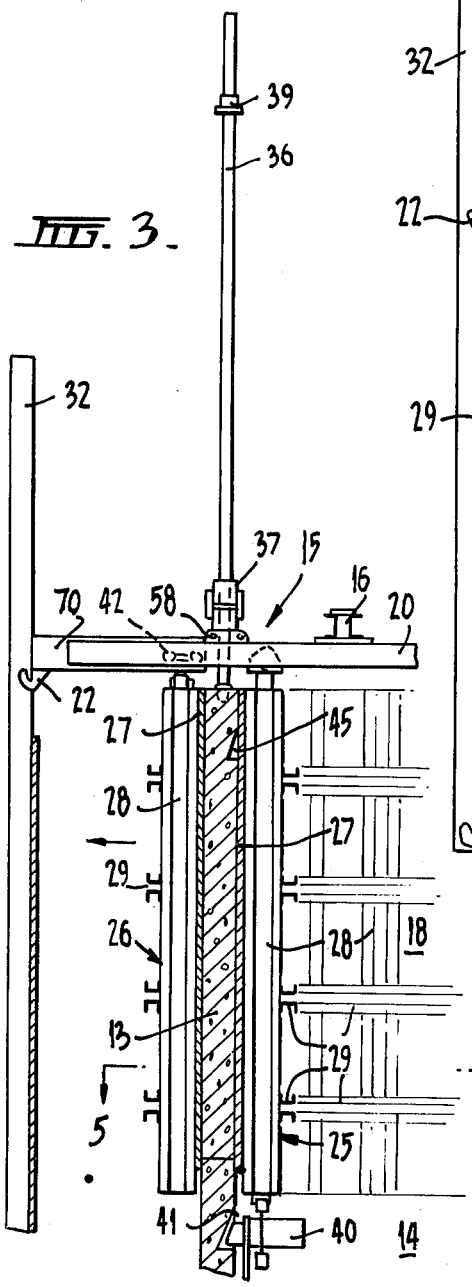
Figure 4:
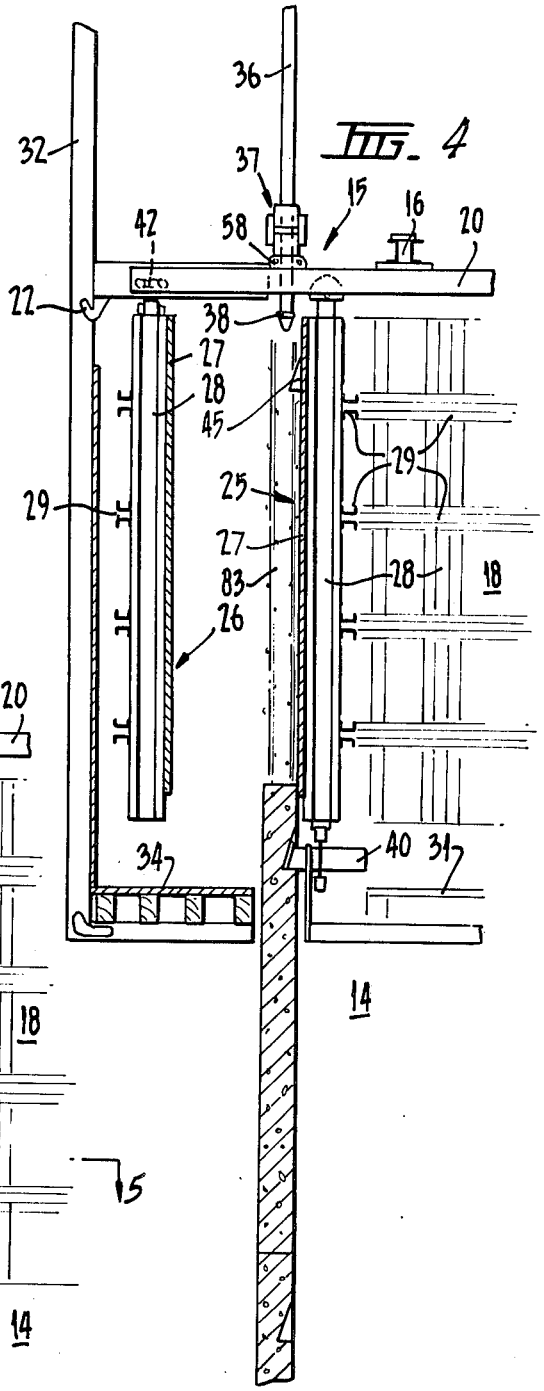
Figure 5:
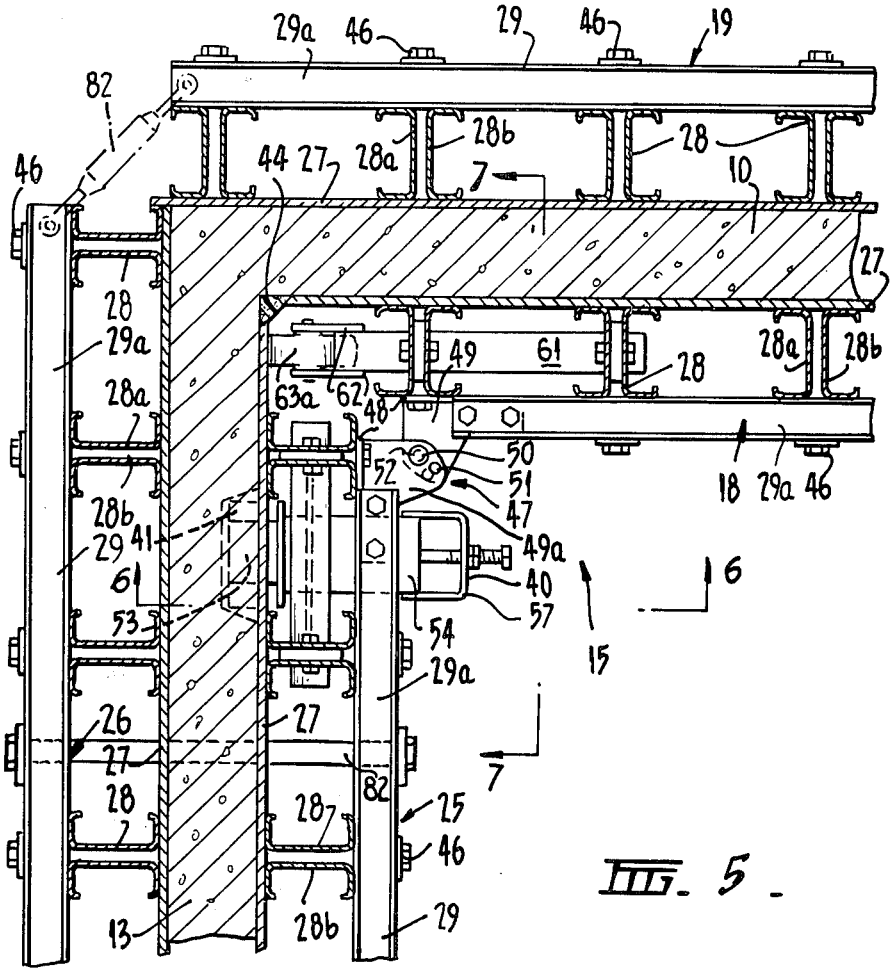
Figure 6:
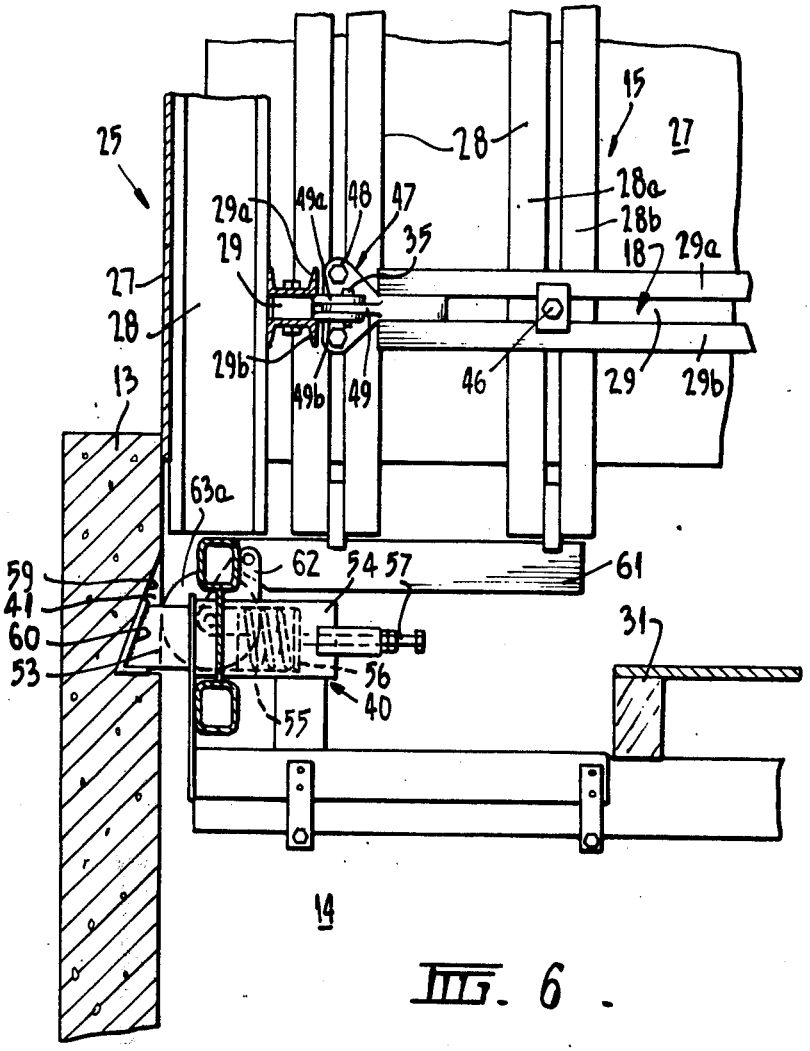
Figure 7:
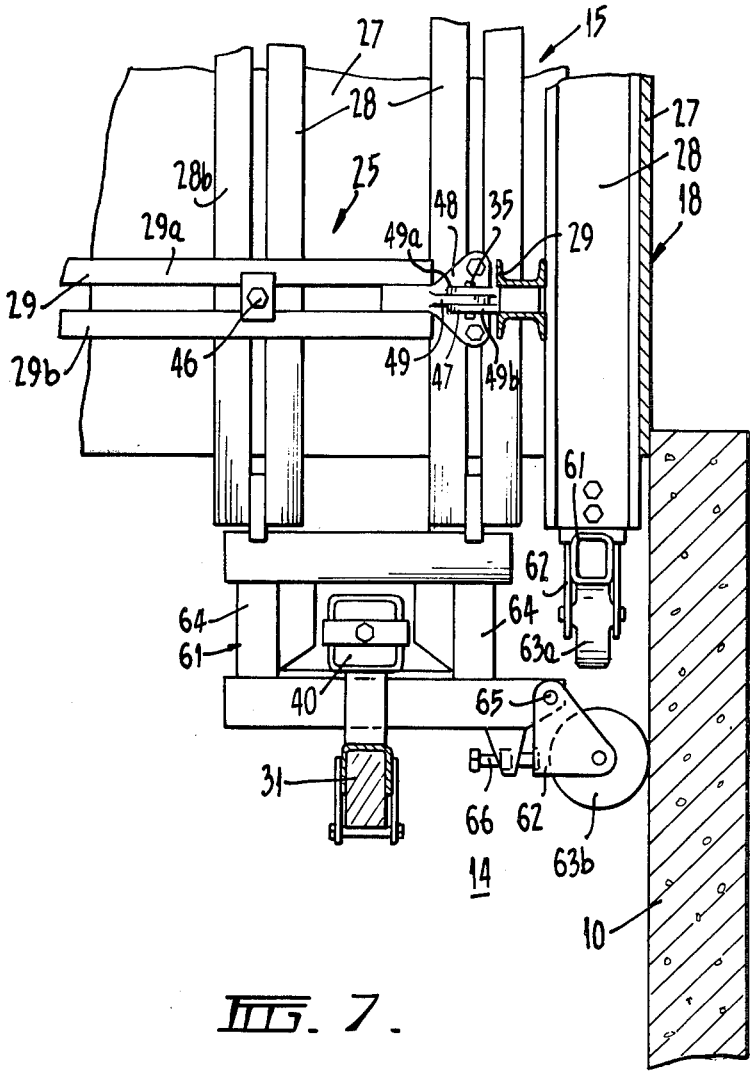
Figure 8:
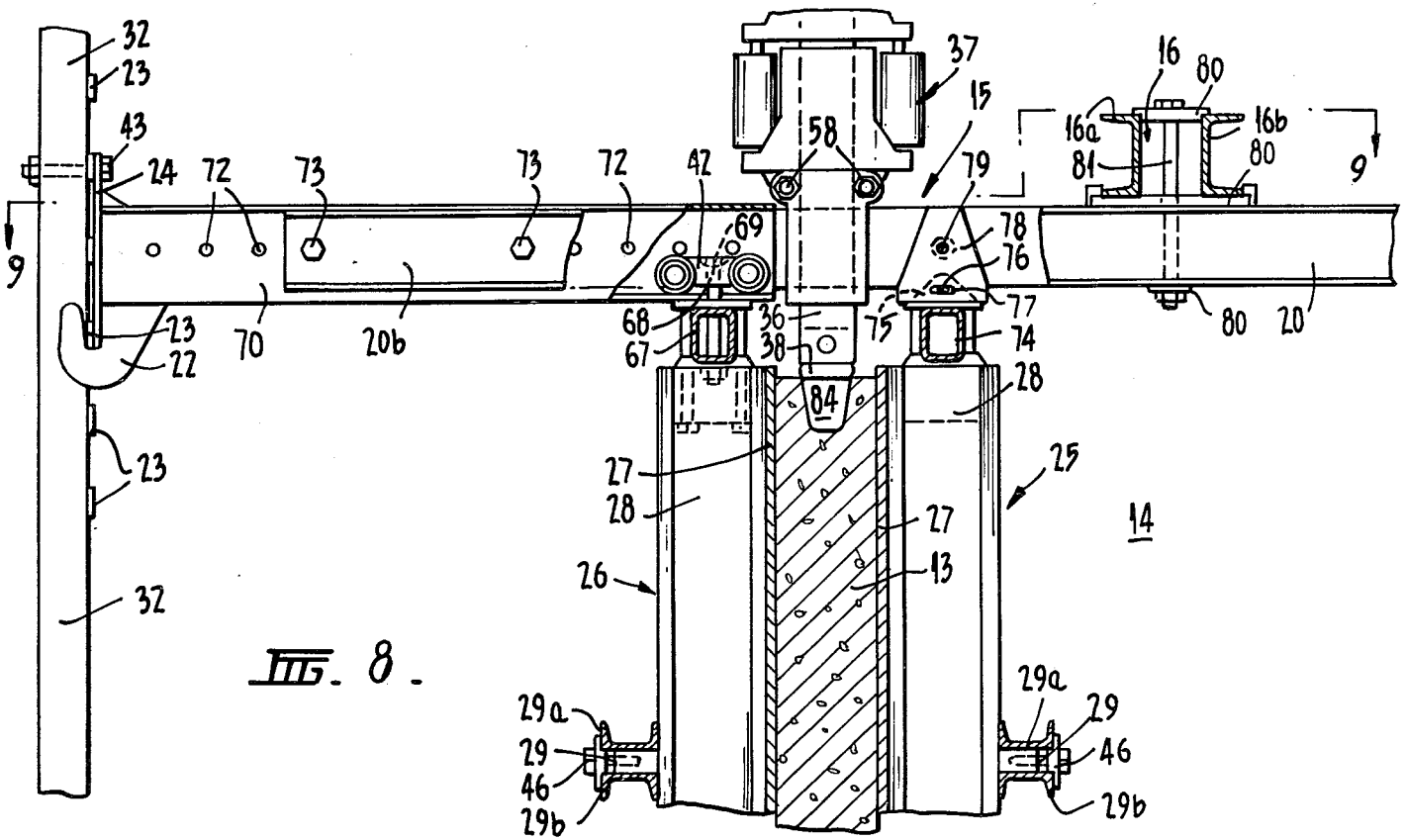
Figure 9:
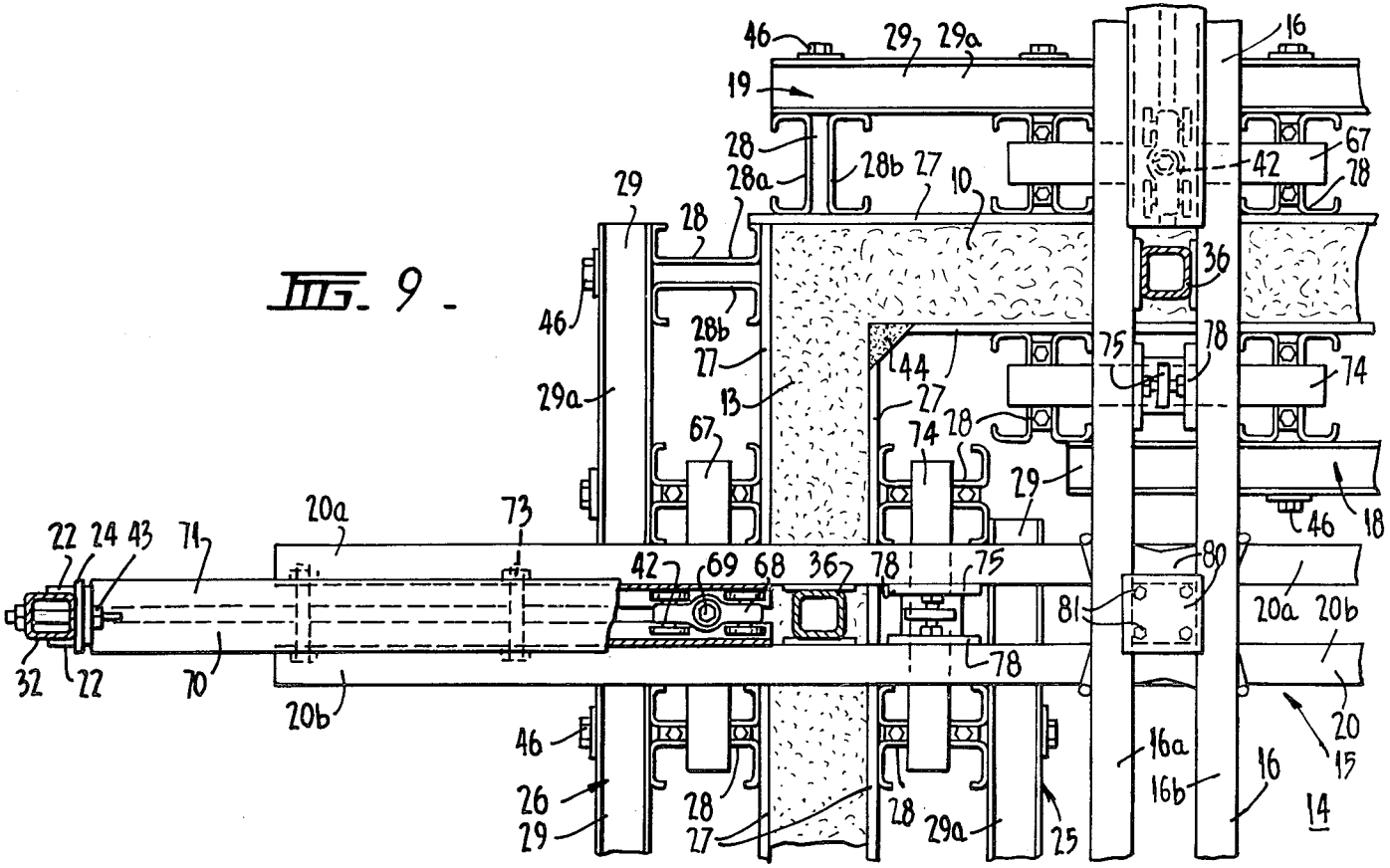
Figure 10:
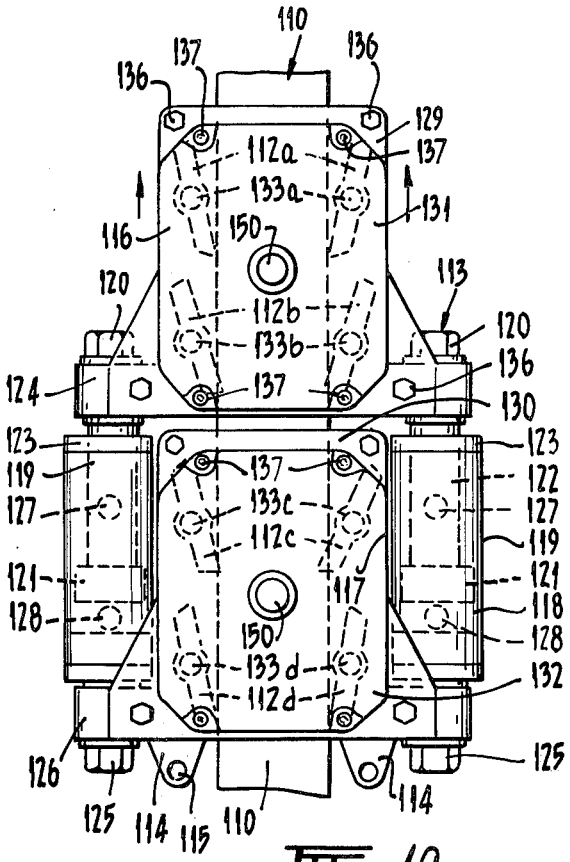
Figure 11:
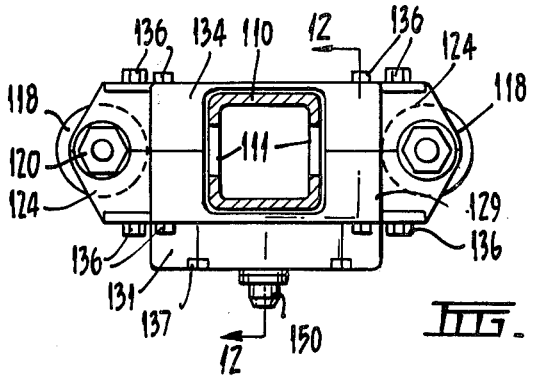
Figure 12:
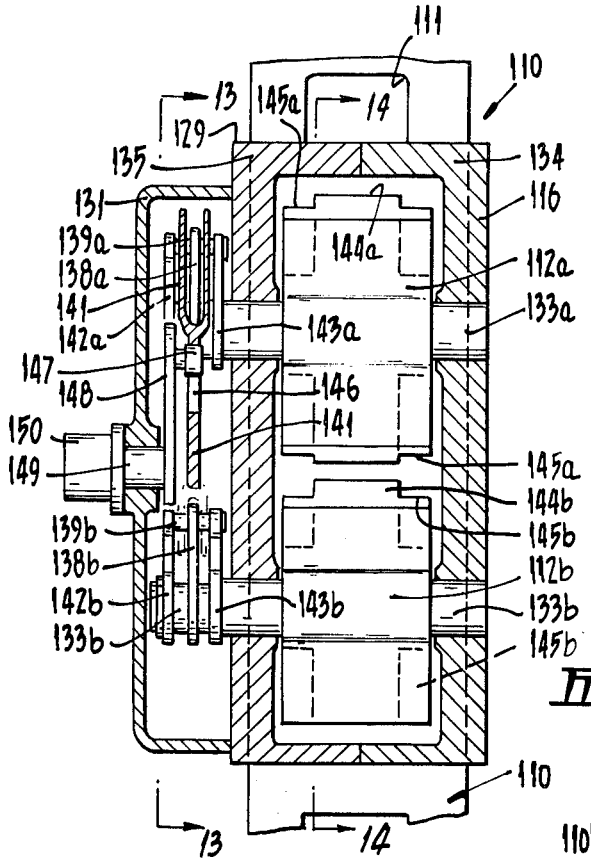
Figure 15:
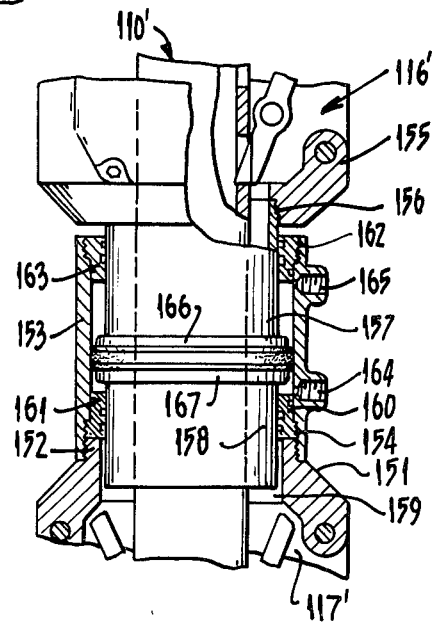
Figure 14:
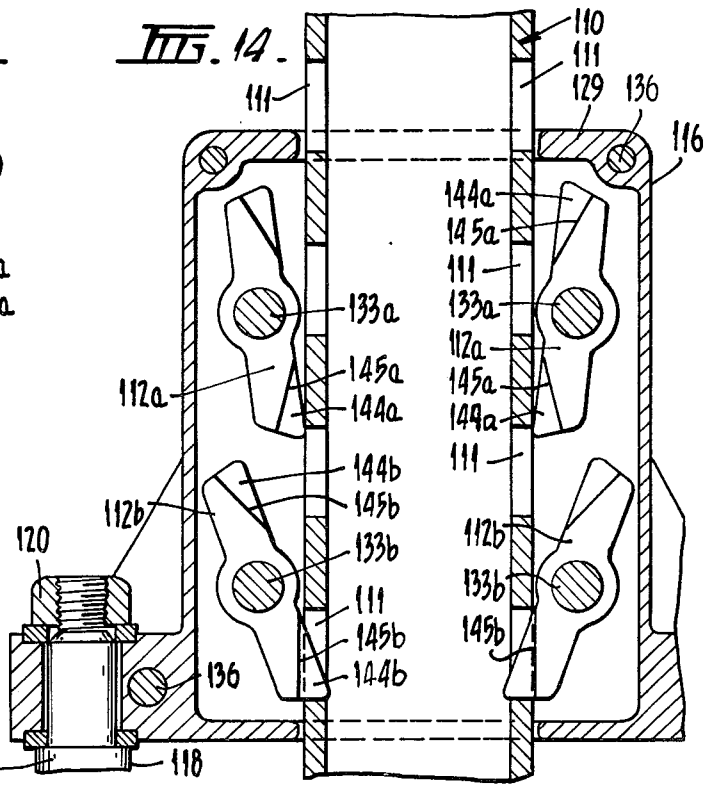
Figure 13:
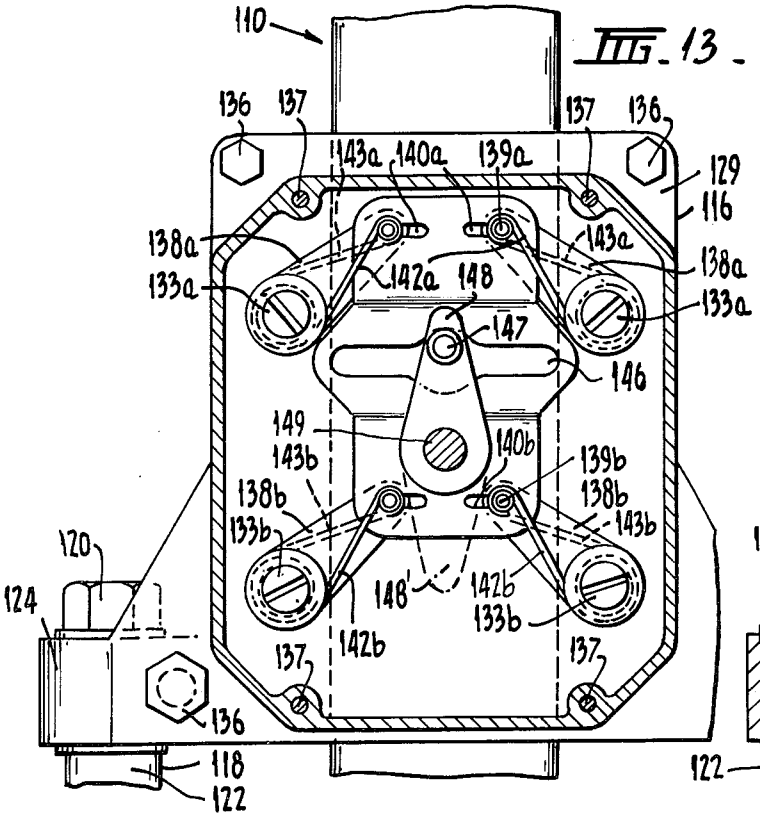

One preferred form of the invention will now be described with reference to the accompanying drawings in which, FIG. 1 is a general plan view of an apparatus according to the invention for progressively constructing walls according to the method of the invention as particularly adapted for forming for enclosing walls of a building space, FIG. 2 is a side cross-sectional view taken along line 2—2 of FIG. 1 showing the structure during a lifting operation of the jacks, FIG. 3 is a detailed view of the apparatus according to FIG. 2, showing it in a position after moulding of a wall section and prior to lifting to a new wall section forming position, FIG. 4 is a view similar to FIG. 3 showing the apparatus in the lifted position with reinforcement inserted and prior to closure of the formwork sections before the pouring of concrete, FIG. 5 is a detailed plan view of a corner section of the apparatus taken along line 5—5 in FIG. 3, FIG. 6 is a detailed side elevational view of the lower edge of the inner formwork section showing detail of the means allowing auxiliary support of the formwork support structure on a lower completed wall section and generally taken through a position in the direction of line 6—6 in FIG. 5, FIG. 7, is a detailed side elevational view of the lower corner edges of the inner formwork sections showing detail of the means for guiding the formwork sections on a complete wall section during movement up the wall and generally taken through a position in the direction of line 7—7 in FIG. 5, FIG. 8, is a detailed side elevational view of the upper section of the structure taken along line 8—8 in figure 1, FIG. 9, is a detailed plan view taken along line 9—9 in FIG. 8, FIG. 10 is a front elevational view of a climbing jack for incorporation into the apparatus according to this preferred form of the invention, FIG. 11 is a plan view of the jack of FIG. 10, FIG. 12, is a side elevational view taken along line 12—12 of FIG. 11 but showing only the upper section of the jack as shown in FIG. 10, FIG. 13, is a front elevational view taken along line 13—13 of FIG. 12, FIG. 14, is a front elevational view taken along line 14—14 of FIG. 12, and FIG. 15, is a side elevational view of a second preferred form of jack suitable for use in the present invention.

Referring to FIGS. 1 and 2, in particular, there is shown an apparatus for forming the four walls 10, 11, 12 and 13 of a building space 14.

The apparatus comprises a formwork support structure generally indicated as 15 comprising a pair of elongate longitudinally extending support beam arrangement 16 and 17, including adjacent parallel extending channel sections 16*a*, 16*b* and 17*a*, 17*b*, and primarily designed to suspend inside and outside formwork sections 18 and 19 at either end of the structure. The formwork support structure 15 also includes transverse beam supports 20 and 21, including adjacent parallel extending channel sections 20*a*, 20*b* and 21*a*, 21*b*. The transverse beam supports 20 and 21 have suspended therefrom inner and outer formwork sections. 25 and 26 on either side of the structure.

Each of the inner and outer formwork sections 18, 19, 25 and 26 comprise a wooden former section 27 with a plurality of vertically extending soldier arrangements 28, of steel channel section together with outer horizontally extending waler arrangements 29.

Referring particularly to FIG. 2, the inner portions of the transverse beams 20 and 21, and the longitudinal beams 16 and 17, support an upper working deck 30. A further lower working platform 31 is suspended beneath the structure and may be pinned to the lower edges of the inner formwork sections after the sections are released from a moulding position, and the structure is being raised, in order to form a stable structure during the raising operation.

Bracing members (not shown) may be incorporated into the structure to act as a wind bracing and to control the verticality of the internal formwork sections..

Further side working decks 33 may be provided on the end portions of the transverse beams 20 and 21, and longitudinal beams 16 and 17 to extend around the upper part of the structure, whilst similar decks 34 may be suspended by vertical adjustable side support members 32 beneath the outer formwork section.

Referring to FIGS. 2 and 3, the formwork support structure 15 is suspended on a previously prepared lower wall section, by means of the jack tubes 36 of a plurality of climbing jack arrangements 37. Details of the jack arrangement will be discussed later in this specification. The lower ends 38 of the jack tubes 36 seat in cavities in the top of the lower wall section and in fact are cast therein during the pouring of the lower wall section. The upper ends of the jack tubes include adjustable stop means 39.

The jack arrangements 37 are of a reversible type, which after lifting of the formwork support structure, can be drawn upwardly to a new casting and lifting position whilst the support structure 15 is supported on the lower wall section by retractable auxiliary supports which, referring to FIGS. 3, 4, 5 and 6, may comprise shear block assemblies 40 movable into and out of position in cavities 41 cast in the lower wall section.

The details of the shear blocks 40 will be described later with reference particularly to FIGS. 5 and 6.

Referring particularly to FIGS. 2, 3 and 4, the outer formwork sections 26, only one of which is shown in these views, are suspended on a track arrangement 42 on the outer portions of the transverse beams and may be moved by manually into and out of the position shown in FIG. 3. The central portion of the transverse beams may have provision to enable adjustment of their length although in the embodiment illustrated this length is static. Adjustment may also be provided between the transverse beams 20 and 21 and the inner formwork sections 25 to allow slight movement of the formwork section away from the inner wall surface during the lifting of the structure. Adjacent the upper edge of the inner formwork sections 25 formwork blocks 45 are provided for forming the shear cavities 41 in the wall section when casting the wall section. In the case of multi-storied building suitable provisions can be made to cast into appropriate wall sections, during construction, supports for the floor elements of the building. Also, where desired, extra formwork can be provided to provide apertures in the wall section such being constructed as to provide for windows, doors, ventilators etc.

Referring particularly to FIGS. 5 to 9 in particular, the vertically extending soldier and horizontally extending waler arrangements 28 and 29 for the inner and outer formwork sections included pairs of channel sections **28*a*, 28*b*, and 29*a* and 29*b* respectively arranged as shown but spaced apart for the receipt of bolted and fastening plate arrangements 46 therebetween for attaching the soldier and waler arrangements (see FIGS. 5, 6, 7, 8 and 9). It is a preferable requirement of the jack arrangements 37 for the present invention that they be capable of reversal after a lifting operation in order to enable the jack tube 36 to be moved back through the arrangement 37**.

The jack tube 36 is of a hollow or solid elongate member with a plurality of closely and evenly spaced apertures or projections (not shown) along its length adapted to receive pawls or like devices, mounted in the jack assembly 37 which in turn support the load being lifted (in this case the formwork support structure 15). The pawls are however also adapted to allow the tube 36 to pass the pawls as the arrangement move in the opposite direction. Details of jack arrangements particularly suitable for achieving this purpose will be described in detail later with reference to FIGS. 10 to 15 of the accompanying drawings.

With particular reference to FIGS. 2, 3, 4 and 8 connection between the jack arrangements 37 and the transverse beams 20 and 21 and the longitudinal beams 16 and 17, are accomplished by bolted connections 58.

Referring to FIGS. 1, 5, 6 and 7, of the drawings corner connection arrangements 47 are provided for adjustably interconnecting the adjacent vertical edges of the inner formwork sections 18 and 25 at the corners of the construction. Each connection arrangement 47 includes vertical connection members 48 attached to adjacent soldier and waler arrangements with a single horizontally disposed plate 49 on one side of the connection arrangement and a pair of vertically spaced horizontally disposed plates **49*a* and 49*b* on the other side of the arrangement. The plate 49 includes a pair of spaced holes 50 and 51, and a pair of plates 49*a* and 49*b* each having a pair of spaced holes 52 and 52'. By adjusting the position of the plates either holes 50 and 52, or 51 and 52' are aligned to receive a connecting pin or bolt 35** thus effecting two adjustment positions.

Referring particularly to FIGS. 5 and 6, the details of the shear blocks 40 and the cooperating shear cavities 41 are shown. The lower ends of the soldiers 28 and the lower working platform 31 are interconnected by an arrangement of structural members which also support the shear block arangements 40. The shear block arrangements 40 includes shear blocks 53 received in hollow guide members 54, in which compression springs 55 are supported between an adjustment plate 56 and the inner end of the shear block 53. An adjustment screw arrangement 57 allows adjustment of the adjustment plate 56 to effectively alter the spring force. The cavity 41 includes an outwardly and upwardly sloping surface 59 and the outer end 60 of the shear block is correspondingly angled, such that during upward movement of the structure the shear blocks 53 will be guided outwardly of the cavity 41 against the action of the biasing spring 55, but upon reaching an upper similar cavity 41 will engage therein to enable support of the structure on the wall section via the shear blocks at the new upper position.

With reference to FIGS. 2 and 7, the soldiers 28 adjacent the corners of the inner formwork sections have roller or wheel support structures generally indicated as 61 attached thereto which in turn carry roller support flanges 62 between which are received rollers or wheels **63*a* and 63*b*. For one wall adjacent the corner the guide roller or wheel 63*a* is supported at a higher level whilst the roller or wheel 63*b* for the adjacent wall is supported at a lower level by virtue of spacer member 64 to avoid interference between the adjacent wheels or rollers at the corners. The support flanges 62 for the wheel or roller 63*b* are pivotally attached at 65 and an adjustment screw arrangement 66 allows the wheel or roller positions to be adjusted toward and away from the wall. A similar adjustment provision is provided for other roller or wheel 63*a***.

Referring to FIGS. 8 and 9, the track arrangements 42 for the outer formwork sections 19 and 26 involve bridging the upper ends of the soldiers for the outer formwork sections 19 and 26 with outer shutter tubes 67 attached thereto and bridging the particular formwork and, adjacent the beam arrangements 20 and 21 or 16 and 17, have wheel bogies 68 attached thereto by bolts 69 and each bogie carries four wheels, two on each side, adapted to ride on, or roll along, the lower flanges of a pair of channel sections 70 and 71 the openings of which face each other and are spaced apart a distance sufficient to allow the bolts 69 to pass therebetween. The channel sections 70 and 71 are sandwiched between the channel sections forming the beam arrangements 20 and 21, or 16 and 17, and are adjustably connected thereto by a plurality of spaced holes 72 for receiving bolts 73 to allow adjustment of the effective length of the outer portions of the beam arrangements when required.

The outermost ends of the channel sections 70 and 71 forming part of the track arrangements 42 carry hook members 22 adapted to engage under a one of a series of horizontal rails 23 on the side support members 32, and the connection is secured by a plate 24, attached by a bolt attachment 43 to the members 32.

Referring also to FIGS. 8 and 9, the inside formwork sections 18 and 25 are pivotally suspended from between the channel sections forming the beam arrangements 20 and 21, or 16 and 17, by an arrangement including inner shutter tubes 74 to which an attachment plate 75 is affixed which carries an attachment pin 76 received in slotted holes 77 provided in a pair of support plates 78 which in turn are bolted at 79 to the channel sections of the beam arrangements. This form of attachments allow some limited movement of the inner formwork sections toward and away from the pouring space or poured wall.

At the points of intersection of the transverse beam arrangements 20 and 21 with the longitudinally extending beam arrangements 16 and 17, attachment means comprising clamping plates 80 with bolts 81 are provided (see FIGS. 8 and 9 in particular).

Referring particularly to FIG. 5, the adjacent corners of inner formwork sections 18 and 25 may be provided with an insert 44 of polyester of other suitable material between adjacent edges of the wooden former sections 27 to effectively seal the corners at this point. The adjacent edges of the outer formwork sections 19 and 26 are held tightly together by turnbuckle arrangements 82 attached between the adjacent edges thereof. Furthermore as particularly shown in FIG. 5, tie bolts 82 engaging the walers 29 for both inner and outer formworks are provided to hold the formworks together during pouring.

Referring once again to FIGS. 2, 3 and 4, the method of construction according to a preferred form of the invention is as follows:

In FIG. 3 there is shown a situation where a wall section has been poured and solidified, the inner and outer formwork sections 25 and 26 are still in position with the lower end 38 of the jack tube 36 embedded in the top of the wall section, whilst the retractable shear blocks 53 are engaging the cavities 41. The formwork support structure 15 is supported by the jack tubes 36 and the shear blocks 53.

Referring to FIG. 2, following solidification of the wall section the turnbuckle arrangemets 82 are disconnected, the tie bolts 82 are removed, the outer formwork sections 19 and 26 are moved away on the supporting track arrangements 42, whilst the inner formwork section 25 may be slightly retracted to disengage from the wall section just cast. The surface of the inner and outer formworks sections may be cleaned by workmen from the various working decks and the holes left by the tie bolts 82 plugged.

The shear blocks 53 are retracted as the climbing jack arrangement 37 is actuated causing the jacks to climb up the jack tube 36 until an appropriate height is reached which may, or may not, be at the adjustable stop 39.

With reference to FIG. 4, when the jacks have lifted the formwork support structure 15 to the appropriate height, the adjustable shear blocks are moved in to engage in the cavities 41 in the then lower completed wall section and thereby support the structure, whilst the action of the jack assemblies are reversed to allow the jack tube 36 to be raised as shown in FIG. 4 to a new position. Reinforcement material 83 and wall blockout forms, if required, are then positioned, the inner and outer framework sections are moved back to a moulding position, turnbuckle arrangements 82 attached, concrete poured into the space and allowed to solidify and the process is repeated to build up successive wall sections.

The lower end 38 of the jack tube 36 is provided with a bearing member 84 (see FIG. 8) to provide a stable support for the jack tube 36 during a lifting operation.

It wil be appreciated that FIGS. 2, 3 and 4 show only one side of a room wall construction, although in this embodiment, the other three walls are being constructed in a similar manner simultaneously.

It will be further appreciated that the concept of the inventive apparatus may be utilized in an apparatus for building two parallel walls or even one wall alone, whilst room spaces having any particular member of surrounding walls may be constructed with a suitably modified apparatus.

Referring to FIGS. 10 to 14 which illustrate a first preferred form of jack, the jack tube 36 is a hollow elongate member with a plurality of closely and evenly spaced apertures 111 along its length adapted to receive reversible pawl sets **112*a*, 112*b*, 112*c* and 112*d* or like devices, mounted on a jack assembly 37 which in turn supports the formwork support structure to be lifted for which ears 114 with holes 115 therein may be provided for the receipt of the attachment bolts 58**.

The jack assembly 37 consists of upper and lower pawl supporting sections 116 and 117 respectively separated, and connected together, by a pair of hydraulic ram arrangements 118 placed on opposite sides of the jack column 36. Each hydraulic ram arrangement 118 comprises a cylinder body 119, attached by means of a bolt 125 to a lower flange 126 on the lower pawl supporting section 117, and a piston 121 adapted to move inside said cylinder body 119 and connected to a piston rod 122 extending through a closure member 123 to a bolted connection 120 at a lower flange 124 for the upper pawl supporting section 116. A port 127 for pressurized hydraulic fluid, and in communication a source of pressurized hydraulic fluid through a selection valve (not shown), is provided in the upper end of each cylinder body 119 to deliver pressurized fluid to, and from, the piston rod side of each piston 121 whilst a further port 128, also in communication with the selection valve, is provided in the lower end of each cylinder body 119 to deliver pressuraized fluid to, and from, the opposite side of the piston. The piston includes a circumferentially extending sealing member whilst appropriate sealing members are also positioned around the piston rod 122 and in the closure member 123 to seal the hydraulic ram arrangement. Relative movement between the upper and lower pawl supporting sections 116 and 117 is achieved by selectively delivering pressurized fluid to one side of the piston and exhausting from the other by virtue of a suitable selection valve, and many forms of valves suitable for this purpose are available and would be adapted in a manner well known to those skilled in the art.

Each pawl supporting section 116 and 117 comprises a main housing 129 and 130 respectively in which the pawl sets **112*a*, 112*b*, 112*c* and 112*d*are supported, and an auxiliary housing 131 and 132 respectively containing mechanisms for selectively biasing the pawls into positions allowing relative movement between the jack assembly 37 and the jack tube in opposite directions. The housing 129 for the upper pawl supporting section 116 supports pawl sets 112*a* and 112*b* one above the other on support axles 133*a* and 133*b* respectively which are positioned midway between the ends of the respective pawls, whilst the housing 130 for the lower pawl supporting section 117 supports pawl sets 112*c* and 112*d* one above the other on support axles 133*c* and 133*d*** respectively and positioned midway between the ends of the respective pawls.

As the details of each pawl supporting section 116 and 117 are identical the following description with particular reference to FIGS. 12, 13 and 14, will be only concerned with the construction of the upper section 116.

The main housing 129 comprises two halves 134 and 134 in the faces of which holes are provided to form bearing supports for the support axles 133*a* and 133*b* and the two halves when assembled are attached by bolt fasteners 136. The auxiliary housing 131 is attached to one face of the main housing 129 by recessed bolt fasteners 137 and contains the mechansim for selectively biasing the pawls.

The pawls 133*a* and 133*b* in each pawl set are selectively biased into positions where either their lower ends or their upper ends bear against the jack rod 36 and at various times during operation engage in the apertures 111 in the jack rod 36.

The mechanism for selectively biasing the pawls such that either their lower or their upper ends engage the jack rod (with particular reference to FIGS. 12 and 13) comprises a pawl link 138*a* and 138*b* for the pawls 133*a* and 133*b* respectively of each set pivotably mounted upon respective axles 133*a* and 133*b*. The ends of the links 138*a* and 138*b* remote from their connection to the axles carry pins 139*a* and 139*b* respectively which slidingly engage in slots 140*a* and 140*b* respectively provided in a vertically movable shift plate 141. With particular reference to FIG. 12 the shift plate 141 is forked at either end and the legs of each fork lie on opposite sides of the respective link 138*a* and 138*b*. A pair of torsion springs 142*a* and 143*a*, and 142*b* and 143*b* respectively, are provided for each pawl. One torsion spring 142*a* and 142*b* of each pair has one end coiled around the respective support axle 133*a* and 133*b* in one direction, with the extremity of that end of the torsion spring held captive to the respective support axle 133*a* and 133*b* by receipt in a hole extending transversely through the support axle, and the spring extends to the associated pin 139*a* and 139*b* respectively for capture hook engagement thereabout in the opposite direction as shown. The other torsion spring 143*a* and 143*b* of each pair engages the axle 133*a* and 133*b* and the associated pins 139*a* and 139*b* in the opposite direction as shown particularly in FIG. 13.

With the shift plate 141 in an upper position the pins 139*a* and 139*b* and the ends of the torsion springs will be in an upward position, and the torsion springs 142*a* and 142*b* will, in this position, maintain a net counter clockwise torque on the support axles 133*a* and 133*b* to maintain the pawls 112*a* and 112*b* with their lower ends biased toward the jack rod 36, in the orientation shown in FIG. 14, such that when aligned with an aperture 111 the lower ends will move into and engage the relevant aperture.

In order to alter the orientation of the pawls such that their upper ends ae biased against the jack rod 36, the shift plate 141 is shifted downwardly to simultaneously draw the pins 139*a* and 139*b* to a downward position, and to draw the links 138*a* and 138*b* to a downwardly inclined position with lateral movement of the pins 139*a* and 139*b* being accommodated in the slotted holes 140*a* and 140*b* rspectively. The downward movement of the pins 139*a* and 139*b*relieves the torsional effect of the torsion spring 142*a* and 142*b* on the respective axles 133*a* and 133*b*, whilst torsion springs 143*a* and 143*b* come into action to rotationally bias the axles 133*a* and 133*b* and the pawls 112*a* and 112*b* attached thereto in the clockwise direction to maintain the upper ends of the pawls bearing under pressure on the jack rod 36, to engage in an aperture 111 during various stages of operation of the jack.

Referring particularly to FIGS. 12 and 14, each pawl 112*a* and 112*b* has cut away sections on either side thereof at either end forming a raised portion 144*a* and 144*b* and ledges 145*a* and 145*b*. The raised portion 144*a* and 144*b* are of a width slightly less than the width of the aperture 111 thereby allowing these portions to enter and engage the apertures, whilst the ledges 145*a* and 145*b*engage and rest against the surfaces adjacent the sides of the apertures to limit the amount of the pawl which enters the aperture to equivalent to the height of the portions 144*a* and 144*b*.

In order to vertically shift the shift plate 141, the effect of which is to alter the direction of the net spring biasing torque applied to, and the resulting orientation of, the pawls 112*a* and 112*b*, the central section of the shift plate 141 is provided with a through slot 146 (see FIG. 13) in which a pin 147 on one end of a shift lever 148 is received. The opposite end of the shift lever 148 is fixedly attached to a shift shaft 149 passing through the face of the auxiliary housing 131 and having an outer end 150 adapted for engagement by a key tool (not shown) to allow rotation of the shaft 149 in either direction. Rotation of the shaft 149 causes rotation of the shift lever 148 attached thereto to the position shown in phantom as 140' and in so doing the pin 147 cooperating with the slot 146 pulls the shift plate 141 and captive pins 139*a* and 139*b* downwardly. The torsion spring ends hooked around the pins 139*a* and 139*b* will be in a downward position, resulting in a reversal of the rotational bias exerted by the respective pairs of torsional springs upon the respective axles and pawls associated therewith, whereby the upper ends of the pawls 112*a* and 113*b* then bear against the jack rod 36. Rotation of the shift shaft 149 a further 180° in either direction shifts the lever 148 back to the upper position shown in FIG. 13, thereby again recessing the direction of the biasing torques imposed by the torsion spring arrangements to return all pawls to the position shown in FIG. 14.

The pawls 112*a* and 112*b*, or 112*c* and 112*d*, in each of the upper and lower sections 116 and 117 are spaced apart a distance greater than the distance between adjacent apertures 111, such that, at any one time only one set of pawls in each section 116 and 117, when the sections are at a fixed position relative to the jack rod, are engaged in the apertures (see FIGS. 10 and 14). The stroke of the hydraulic ram arrangements 118 are such that the relative movement between each section 116 and 117 and the jack rod 36 wil be over distance such that one of the sets of pawls in each section previously not engaged in apertures will move to an engaging position, whilst the other set of pawls formerly engaged will move out of engagement.

Referring particularly to FIG. 10, to enable the jack assembly 37 to move up the jack rod 36 carrying the formwork support structure supported therefrom, all pawls 112*a*, 112*b*, 112*c* and 112*d* are biased towards the position shown in FIG. 10, that is, with their lower ends bearing against the jack rod 36 whereby they engage, or tend to engage, in the apertures 111. In the position shown in FIG. 10 the lower set of pawls 112*b* in the upper section 116, and the upper set of pawls 112*c* in the lower section 117, are engaged in apertures 111, whilst pawls 112*a* and 112*d* are not. Upon applyig fluid pressure through the lower port 128 and exhausting through the upper ports 127, the hydraulic ram arrangement 118 lift the upper jack section 116, and during upward movement for the full stroke of the rams 118, the lower pawls 112*b*disengage from the apertures 111 and upon reaching the full extent of the stroke the upper pawls 112*a* then engage in apertures 111 effectively space two above the one from which the pawls 112*b* have disengaged. Meanwhile lower section 117 has remained relative to the jack rod and supported on the pawls 112*c* which have remained in engagement with apertures 111. Upon reversal of the point of delivery of the fluid pressure to the ram arrangements the upper section 116 remains fixed relative to the jack rod 36 and supported on pawls 112*a*, but the lower section 117 then lifts to once again meet the upper section 116 with the upper pawls 112*c* disengaging from the apertures 111 against the action of their active torsion springs and the lower pawls 112*d*, upon reaching an aperture, engage therein. Upon further reversal of pressurised fluid to the ram arrangements the upper section 116 again lifts, pawls 112*a* disengage from the aperture 111, pawls 112*b* move into and engage the next set of apertures in their path whilst the lower section 117 remains supported on pawls 112*d*. Still further reversal of fluid pressure to the ram arrangement 118 lifts the lower section 117 up to meet the upper section again, pawls 112*d* disengage from their apertures, pawls 112*c*move into the next set of apertures in their path and the oreintation of all the pawls having regard to their engagement in the apertures has returned to the situation as illustrated in FIG. 10 except that the whole jack has effectively risen a distance equivalent to the distance between an adjacent pair of apertues. As the cycle of movement is repeated the jack and thus the load suspended thereon climbs up the jack rod 36.

When it is desired to lift the jack rod 36 up through the jack assembyl 37, that is, by holding the jack assembly 37 at a fixed height via the auxiliary support means and lifting the jack rod 36 through the assembly 37, such as required to carry out the inventive continuous wall building technique, the orientation of all pawls is reversed in the manner previously described, such that the upper ends of all pawls engage, or tend to engage, the apertures 111. The pawls instead of resting on the lower edges of the apertures, as was the case with the jack assembly when moving up the jack rod, bear against the upper edges of the apertues 111 which has the effect during movement of the ram arrangement to push the jack rod up through the assembly 37 whilst the assembly 37 is held at a fixed position.

Referring to FIG. 15 of the drawings, an alternative form of jack is described. The upper and lower jack sections 116′ and 117′ and the jack rod 36′ are basically the same as the sections 116 and 117 and rod 36 in the embodiment of FIGS. 10 to 14, and in so far as the arrangement and operation of the pawls, and the mechanisms for reversing their orientation to reverse the relative movement between the jack assembly and the jack rod are concerned, these are identical. In this alternative embodiment the modification merely relates to an alternative form of hydraulic ram arrangement for obtaining relative movement between the upper and lower jack sections 116′ and 117′.

In this embodiment other hydraulic ram arrangements 118 and the provision for their attachment to the upper and lower jack sections 116 and 117 in the embodiment of FIGS. 10 to 14 are dispensed with. The lower jack section 117′ is formed at its upper end, or has attached thereto, a tapering connection portion 151 merging into an upwardly extending cylindrical externally threaded flange 152. An outer cylindrical sleeve 153 internally threaded at one end 154 for cooperation with the threaded flange 152 is provided. The lower end of the jack section 116′ also has a tapering connection portion 155 formed thereon, or attached thereto, and is internally threaded at 156 to receive a hollow piston support member 157 which surrounds the jack rod 36′ and is adapted to extend downwardy inside, coaxially with respect to, but spaced from, said sleeve 153 with its lower end 158 received in a circular opening 159 inside the flange 152 and connection portion 151 on the lower jack section 117′.

A lower sealing member 160 is positioned between the piston support memeber 157 and the sleeve 153 adjacent the threaded flange 152 and carries an externally threaded portion 161 for engagement with the internal thread at the lower end 154 of the sleeve 153, and carries a number of inner and outer sealing rings. The upper end of the sleeve 153 is internally threaded at 162 and receives a cooperatingly externally threaded upper sealing memb34 163 positioned between the sleeve 153 and the piston support member 157 with a number of inner and outer sealingrings provided thereon.

The arrangement and disposition of the sleeve 153, the piston support member 157 and the sealing members 160 and 163, effectively provide an annular sealed cavity into which pressurised fluid can be alternatively introduced and exhausted through ports 164 and 165 in the sleeve and adjacent either end thereof. The piston support member 156 carries an annular piston member 166 fixed thereto and having sealing rings 167 provided in the circumferential surface thereof and movble back and forth with the support member 157 as pressurized fluid is directed through port 164 to one side of the piston member 166 whilst fluid on the other side exhausts through port 165, and vice versa. This arrangement is merely an alternative to using the separate hydraulic ram assembly 118 of the embodiment of FIGS. 10 to 14.

It should be understood that the hydraulic ram arrangements 118 could be replaced by pneumatic ram arrangements or alternatively any other form of force applying means positioned between the upper and lower jack sections 116 and 117. Alternatively the pawls should have their ends adapted to engage projections provided on the external surface of hollow or solid jack rods or tubes. Alternatively in the case where apertures are provided, the apertures may be provided in a solid body and consist merely of cavities evenly spaced along and in the surface of the solid columns.

Furthermore, although each of the jack sections 116 and 117, or 116′ and 117′, carries two sets of pawls, in a simpler embodiment only one set of pawls may be provided in each section and the stroke of the ram arrangements, the spacing between the apertures 111 and the distance between the pawls in the lower and upper sections are arranged such that whilst one section is moving relative to the jack rod, or the jack rod is moving through one of the sections, the pawls in the other section are engaging the apertures and supporting the assembly.

The various components of the whole assembly may be constructed of any suitable material such as steel.

The various components of the apparatus may be manufactured from suitable components such as structural steel sections whilst the jacks may also be constructed from steel components.

I claim:

1. A method for prograssively constructing a plurality of substantially vertical walls of hardened cementitious material in successive, vertically incremental castings, said method comprising:

I. providing a plurality of pairs of formwork sections in a first casting position, each pair comprising a substantially vertical frost formwork section and a facing substantially vertical second formwork section, at least on pair of formwork sections associated with each wall to be built, wherein said formwork sections define at least in part a cavity for an incremental casting which is to be made, while supporting said formwork sections by at least one retractable support from a completed incremental casting of first hardened cementitious material, II. interlocking said first formwork sections and interlocking said second formwork sections, and therafter casting second hardenable cementitious material in said cavity and permitting same to harden, III. thereafter disengaging said framework sections from the second hardened cementitious material, and moving each entire said first formwork sectio laterally and horizontally away from the second formwork section at least a distance to permit a person to pass between the first and second formwork sections, IV. raising said plurality of pairs of formwork sections simultaneously from the first casting position to a vertically higher second casting position by raising a common, rigid support structure, from which all of said formwork sections are suspended, from a first support position to a second vertically higher support position while A. supporting said common support structure on said second hardened cementitious material, B. disengaging said retractable support from supporting contact with said hardened cementitious material, C. interlocking said second formwork sections in a structurally rigid and stable assembly, and D. guiding said interlocked second formwork sections by contact with at least one hardened incremental wall section of cementitious material, to maintain alignment of and to stablize said second formwork sections, and V. repeating the above steps until the desired wall height has been achieved.

2. A method according to claim 1, wherein at least four walls defining at least one cell are constructed.

3. A method according to claim 2, wherein each of said walls are formed at substantially right angles to at least one adjacent wall.

4. A method according to claim 3, wherein a plurality of walls forming a gridwork of contiguous cells are formed, and said formwork support structure means extends over said gridwork of contiguous cells and is common to all cells.

5. A methodaccording to claim 4, wherein a plurality of cavities are formed in the completed incremental castings of hardened cementitious material, and said retractable support means are carried by said second formwork sections and are movable into and out of engaging reception with said cavities.

6. Process of claim 4, wherein said support structure is raised by operating reversible jack means engaged with said second hardened cementitious material, and said process also includes the steps of disengaging said jack means from said second hardened cementitious material and withdrawing at least most of any portion of said jack means in said cavity substantially vertically upwards out of said cavity after said raising step and before the next said casting step.

7. A method according to claim 6, wherein said formwork support structure is supported on jack means which are vertically movable from a lower jack position to an upper jack position and include generally vertical pole means for engaging the top of a completed wall section and jack body means secured to said formwork support structure, said pole means and said jack body means being generally vertically movable reltive to each other so that movement of said jack body means in a generally upward vertical direction along said pole means will effect movement of said formwork sections from said first casting position to said second casting position.

8. A method according to claim 7, wherein said jack body means is rversible so that said jack pole means and said jack body means selectively move upwardsly in relation to one another.

9. A method of progressively constructing at least one substantially vertical wall of hardened cememtitious material in successive, vertically incremental castings, including the steps of supporting a formwork support structure means on a completed incremental casting by jack means with said formwork support structure extending over said at least one wall and forming a common, rigid supporting assembly for a plurality of pairs of formwork sections, at least one pair of formwork sections associated with each wall to be built, each pair of formwork sections comprising a first formwork section and a facing second formwork section, said first formwork section being suspended from said formwork support structure means in a substantially vertical position, and said second formwork section being suspended from said formwork support structure means in a substantially vertical position, raising said formwork support structure means by said jack means to lift all of said formwork sections simultaneously substantially vertically upward from a first casting position to a second casting position, engaging retractable support means with at least one completed wall section of hardened cememtitious material to support said formwork support structure therefrom, and disengaging said jack means from said completed incremental casting and moving said jack means to a vertically upper position while supporting said formwork support structure on said retractable support means, moving at least one formwork section of a pair into a position relative to the other section of the pair to provide a cavity thereinbetween for receiving cementitious material, the top of the previous incremental casting defining the bottom of said cavity, introducing a quantity of cementitious material into said cavity, allowing the cementitious material in said cavity to solidify to form a subsequent incremental casting, and disengaging said second formwork section from the hardened cementitious material in said cavity, and moving each entire said first formwork section laterally and horizontally away from the second formwork section at least a distance to permit a person to pass between the first and second formwork sections, associating the jack means and the retractable support means so that there are alternate periods wherin said formwork support structure means and formwork sections are exclusively supported by said retractable support means and other periods wherein same are exclusively supported by said jack meaans; provided, however, that during progressive wall construction, at least one of said jack means or said retractable support means supports said formwork support structure means, and interlocking at least one of the formwork sections of a pair with a formwork section of another pair to produce a structurally rigid and stable assembly of formwork sections during the lifting of said formwork sections between said first casting position and said second casting position, and guiding at least some of the interlocked formwork sections from at least one completed wall section of hardened cementitious material to maintain alignment and to stabilize same during lifting between said first casting position and said second casting position.

10. A method according to claim 9, wherein the formwork sections which are interlocked include said second formwork sections, and the interlocked second formwork sections are guided.

11. A method according to claim 9, wherein each of the formwork sections of a pair of formwork sections are interlocked to a corresponding formwork section of an adjacent pair during the casting of cementitious material, and sealing means are located between at least some of adjoining formwork sections to effectively seal same against escape of cementitious material during the casting operation.

* * * * *